United States Patent [19]

Carson

[11] Patent Number: 4,658,768

[45] Date of Patent: Apr. 21, 1987

[54] ENGINE

[76] Inventor: Douglas T. Carson, 7220 Francis Cir., Lincoln, Nebr. 68505

[21] Appl. No.: 892,743

[22] Filed: Jul. 31, 1986

Related U.S. Application Data

[60] Continuation-in-part of Ser. No. 749,419, Jun. 27, 1985, abandoned, which is a division of Ser. No. 622,195, Jun. 19, 1984, Pat. No. 4,543,919, which is a continuation-in-part of Ser. No. 334,963, Dec. 28, 1981, Pat. No. 4,485,769.

[51] Int. Cl.[4] ..... F02M 75/32

[52] U.S. Cl. ..... 123/56 BC; 123/61 R; 123/197 AC

[58] Field of Search ..... 123/56 R, 56 A, 56 B, 123/56 AC, 56 BC, 58 R, 58 A, 61–63, 197 R, 197 A, 197 AB, 197 AC

[56] References Cited

U.S. PATENT DOCUMENTS

| | | | |
|---|---|---|---|
| 1,274,811 | 8/1918 | Sullivan | 123/61 R |
| 1,399,666 | 12/1921 | Short | 123/56 AC |
| 2,588,666 | 3/1952 | Slemmons | 123/63 |
| 3,258,992 | 7/1966 | Hittell | 123/56 BC |
| 3,598,094 | 8/1971 | Odawara | 123/58 A |
| 3,946,706 | 3/1976 | Pailler | 123/56 BC |
| 4,078,439 | 3/1978 | Iturriaga-Notario | 123/197 R |

*Primary Examiner*—Craig R. Feinberg
*Attorney, Agent, or Firm*—Vincent L. Carney

[57] ABSTRACT

To reduce space requirements, vibrations and certain stresses in an engine, a different one of two pistons is mounted on each end of a single piston rod to which the crankshaft is attached by a cylindrical shaped connector that orbits around the crankpin while rotating inside the piston rod. The crank interfaces directly with the piston rod through gear portions or a cam-cam follower through the center of each stroke. To reduce vibrations and certain stresses in an engine, a different one of two pistons is mounted on each end of a single piston rod to which the crankshaft is attached by two arms extending orthogonally from its central portion, each arm being mounted to a different one of two different connecting rods. To balance inertia forces, two oppositely rotating crankshafts are counter-weighted to balance the inertia forces of the assembly in its axis of oscillation and to balance each other outside that axis of motion, or two piston assemblies oscillate opposingly in the same axis eliminating the need for the crankshafts to balance their inertia forces.

8 Claims, 19 Drawing Figures

FIG. 1
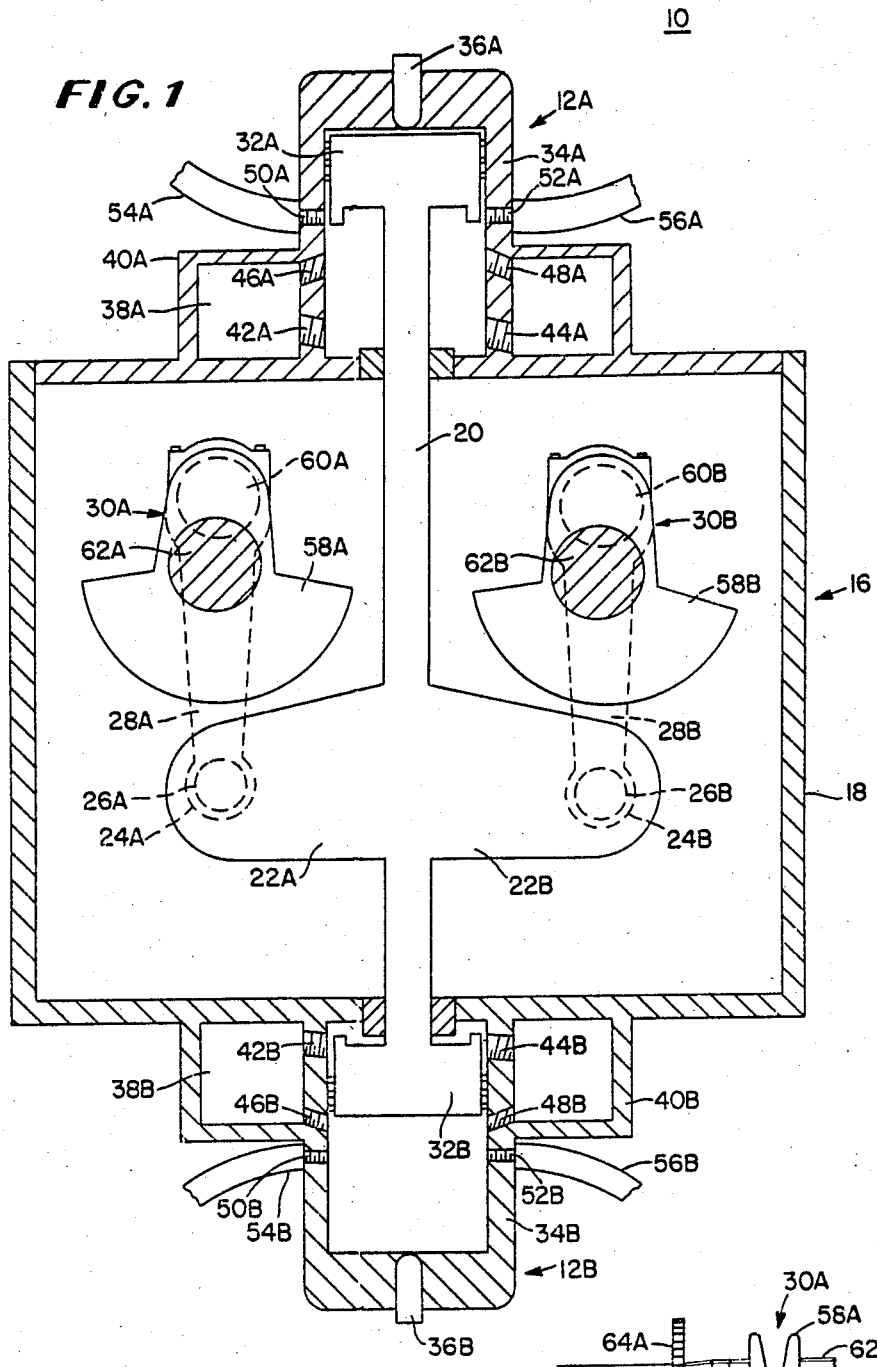
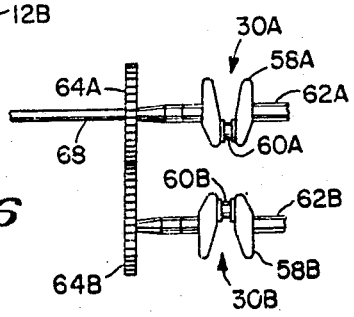
FIG. 6

ENGINE

REFERENCE TO RELATED APPLICATIONS

This application is a continuation-in-part of application Ser. No. 749,419, filed June 27, 1985, now abandoned which is a division of application Ser. No. 622,195, filed June 19, 1984, now U.S. Pat. No. 4,543,919, which is a continuation-in-part of application Ser. No. 334,963 filed Dec. 28, 1981, now U.S. Pat. No. 4,485,769.

BACKGROUND OF THE INVENTION

This invention relates to reciprocating piston engines.

In one class of combustion engines, the engine includes reciprocating pistons which drive an eccentrically mounted cam shaft through piston and connecting rods. Such engines are subject to vibrations resulting from periodic unbalanced vertical inertia forces of pistons and connecting rods and lateral inertia forces created by crankshaft counterweights as they rotate. To reduce the effect of this vibration, multiple cylinders are frequently included.

In prior art types of this class of engine, vibrations are reduced by increasing the number of cylinders and the length of the connecting rods.

The prior art engines have several disadvantages such as (1) a large number of cylinders increases costs and complexity, especially in diesel engines; (2) if long connecting rods are used, engine size is increased; (3) if the rod length to crank radius ratio is decreased, the ratio of inertia forces for the top of the stroke compared to the bottom of the stroke is increased, and the ratio of time that the piston spends in the upper half of the stroke as opposed to the lower half is decreased which respectively increases vibrational problems, decreases fuel burn time per revolution and limits maximum diesel RPM; and (4) the crankshaft deaccelerates the pistons as they approach the end of each stroke and then reaccelerates them, resulting in high stress on cranks, bearings and other components plug energy robbing friction.

SUMMARY OF THE INVENTION

Accordingly, it is an object of the invention to provide a novel reciprocating piston engine.

It is a further object of the invention to provide a reciprocating piston engine with reduced vibrations.

It is a still further object of the invention to provide an engine in which a plurality of crankshafts operate together to reduce vibrations.

It is a still further object of the invention to provide a reciprocating piston engine with a connector between the piston and the crank that reduces engine vibrations.

It is a still further object of the invention to provide a reciprocating piston engine with a connector between the piston and the crank that reduces engine size.

It is a still further object of the invention to provide a reciprocating piston engine with a connector between the piston and the crank that increases maximum fuel burn time per revolution for diesel engines.

It is still a further object of the invention to provide a reciprocating piston engine having a connector between the piston assembly and the crank with a gear type interface between the crank and piston assembly to insure continuity of piston assembly movement through the center of each stroke.

It is still a further object of the invention to provide a reciprocating piston engine having a connector between the piston assembly and crank with a cam slider interface to insure continuity of piston assembly movement through the center of each stroke.

It is still a further object of the invention to provide a reciprocating piston engine with an improved method of communicating piston side thrust to a unique section of cylinder wall in conjunction with improved lubrication to this surface.

It is still a further object of the invention to provide a reciprocating piston engine in which the crank undergoes less stress in maintaining a reciprocating motion for the pistons.

It is a still further object of the invention to provide a reciprocating piston engine which is economical in construction.

In accordance with the above and further objects of the invention, a piston assembly is attached to the crankshaft by a rotating connector which receives the crankpin and which rotates in a hole in the piston rod. The connector has an offset hole into which the crankpin fits. The hole is offset from the center of the connector by a distance equal to the crank radius.

As the crank rotates in one direction, the connector rotates in the other since the center of the connector is restricted by the housing and sidewalls to reciprocating motion except at the center of each stroke where it can experience two sets of motion. To insure continued reciprocation through this point, a control mechanism may be provided which in the preferred embodiment is a gear interface or cam-slider interface or cam cam-follower interface between the crank and piston assembly. The piston stroke is twice the offset plus twice the crank radius or four times the crank radius.

To lower crank stress and bearing friction, the piston assembly is advantageously constructed with each of two pistons connected to opposite sides of the piston rods for power strokes in opposite directions with a connector housing between the pistons. The two-piston assembly oscillates back and forth in a two-stroke cycle governed by the crank.

Most of the deacceleration results from the compression of gases as one of the pistons completes the compression stroke. The compressed gas and burning fuel accelerate the assembly in the opposite direction as the power stroke ensues. The same events will occur with the other piston ½ revolution later.

In one embodiment, the inertia forces are balanced by two two-piston assemblies sharing the same center axis while moving with equal velocity and momentum but in opposite directions. Two connectors and two cranks are required. To insure continuity of reciprocation through the center of each stroke, a cam-cam follower interface between the crank and piston assembly is used. Forced oil lubrication to cylinder walls reduces side thrust friction.

In another embodiment, balancing of the inertia forces is accomplished by constructing a two-piston assembly with two symmetrical housings to hold two connectors which drive two oppositely rotating cranks. The cranks are counterweighted to balance the inertia forces of the assembly in the assembly's axis of oscillation while balancing themselves in the axis at 90 degrees to the oscillation axis.

In still another embodiment, connecting rods are employed but two arms extend outwardly orthogonal to the piston rod in opposite directions with connecting rods being mounted to each of the arms, one on each side of the piston rod. The crankshafts are driven and weighted so that the inertia forces of the two crankshafts balance each other in a lateral direction, with the inertia forces both turning inwardly at the same time and outwardly at the same time from the crankshaft. The vertical inertia forces of the crankshafts balance most of the inertia forces of the moving two pistons and connecting mechanism.

Each of the cylinders has mounted adjacent to it one or more plenum chambers and is vented to the plenum chamber. The vents are positioned such that, when the pistons move downwardly toward the crankcase in a power stroke, air is compressed within the plenum chamber and when the piston reaches the bottom, the air is vented from another vent into the cylinder to aid in exhausting fumes through still other ports.

This engine has several advantages such as: (1) it is economical, particularly in a two-cylinder diesel engine since it provides relatively vibration-free power without the expense of a larger number of cylinders and fuel injectors; (2) it provides relatively vibration-free operation; (3) it is relatively simple in construction and is economical; (4) it provides reduced engine size; and (5) it provides a more economical engine due to less continuous crank stress and corresponding friction.

SUMMARY OF THE DRAWINGS

The above noted and other features of the invention will be understood more completely from the following detailed description when considered with reference to the accompanying drawings in which:

FIG. 1 is a simplified sectional view of an embodiment of the invention;

FIG. 6 is a simplified plan view, in section, showing a portion of the embodiment of FIG. 1;

DETAILED DESCRIPTION

Figure 2:
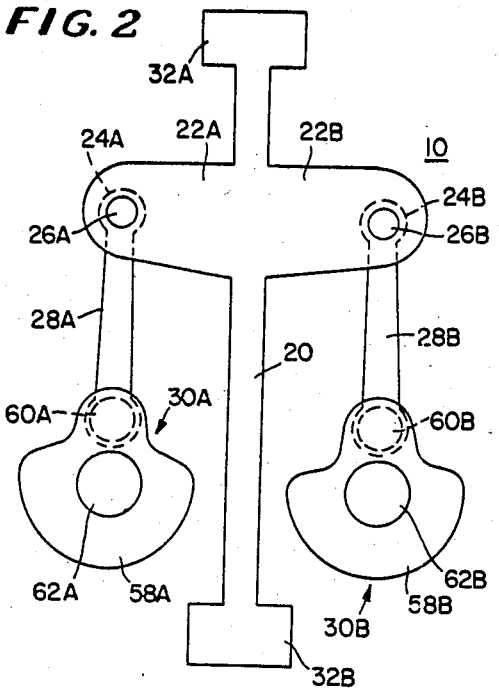
FIGS. 2–5 are developed views showing the operation of the embodiment of FIG. 1 with a slightly different apparatus.

In FIG. 1, there is shown a two-cylinder, two-cycle, balanced diesel engine 10 having first and second cylinders 12A and 12B and a crankcase 16. The first and second cylinders 12A and 12B are aligned with each other on common axis which passes through the center of the crankcase 16 for cooperation with a single piston rod 20 therein. Generally, the first and second cylinders 12A and 12B and the axis are vertically oriented but horizontal orientation is possible.

The crankcase 16 includes a housing 18 forming a compartment which supports the first and second cylinders 12A and 12B on opposite sides and has located along a central axis between the first and second cylinders 12A and 12B the single piston rod 20 aligned with the first and second cylinders 12A and 12B so that as the single piston rod 20 moves further into the first cylinder 12A, it moves further out of the second cylinder 12B and vice versa. Extending outwardly from opposite sides of the single piston rod 20 within the housing 18 are two wings, 22A and 22B, each having on its end a corresponding one of the bores 24A and 24B containing a corresponding one of the bearing shells 26A and 26B. A first connecting rod 28A has one end rotatably mounted in the bore 24A for rotation within bearing shell 26A and a second connecting rod 28B has one end mounted within the bore 24B for rotation with the bearing shell 26B.

Eccentrically mounted to the first connecting rod 28A is a first crank 30A and eccentrically mounted to the second connecting rod 28B is a second crank 30B. On the opposite ends of the single piston rod 20 and within the respective cylinders 12A and 12B are conventional pistons 32A and 32B respectively. The conventional pistons 32A and 32B are mounted so that as one moves toward the crankcase 16, the other moves away from the crankcase 16 so that one of the conventional pistons is compressing air in the case of a diesel engine while the other is being powered by the expanding gas formed after ignition.

In the preferred embodiment, the diesel engine 10 is a two-cylinder diesel engine and consequently the cylinders 12A and 12B include cylinder walls 34A and 34B respectively which receive conventional diesel fuel injectors 36A and 36B respectively. The timing of the fuel injection, air compression and venting is conventional except that cylinders include corresponding toroidal plenum chambers 38A and 38B formed by toroidal walls 40A and 40B positioned to be vented into and from corresponding ones of the cylinders 12A and 12B.

To cause the compression of air in the toroidal plenum chambers 38A and 38B and use of the compressed air to aid in exhausting the cylinders 12A and 12B, vent ports are positioned in the cylinder walls 34A and 34B to communicate between the toroidal plenum chambers 38A and 38B and the corresponding inner chambers of the cylinders 12A and 12B such as shown at 42A and 42B and 44A and 44B. Vents are also positioned in the cylinder walls 34A and 34B at a position adjacent to the top of the toroidal plenum chambers 38A and 38B to communicate between the inner part of the corresponding cylinders 12A and 12B and the portions of the toroidal plenum chambers 38A and38B most remote from the crankcase 16 such as those shown at 46A and 46B and at 48A and 48B.

The conventional pistons 32A and 32B have a height in the direction of the longitudinal axis sufficient so that when they are in their uppermost position adjacent to the top of the cylinders 12A and 12B, all of the vents of the cylinder walls 34A and 34B and the toroidal plenum chambers 38A and 38B are open and when they are in their lowest position, closest to the crankcase 16, the vents adjacent to the crankcase 16 such as 42A, 42B, 44A and 44B are closed by its corresponding piston but the ones most remote from the crankcase 16 such as at 46A, 48A, 46B and 48B are open. With this structure, as the conventional pistons 32A and 32B move toward the crankcase 16, air is forced at first through both vents and then through the bottom vent in the toroidal plenum chambers 38A and 38B and when they reach the position closest to the crankcase 16, the compressed air in the toroidal plenum chambers 38A and 38B is released into the cylinders 12A and 12B to aid in exhausting it through the uppermost vents.

Exhaust vents are provided at a location where the rim of the conventional pistons 32A and 32B block them when the pistons 32A and 32B are in a position most remote from the crankcase 16 and permit them to be opened when they are in a position adjacent to the crankcase 16 such as at 50A and 52A for cylinder 12A and 50B and 52B for cylinder 12B. Appropriate tubing is provided such as that shown schematically at 54A and 56A and at 54B and 56B to remove the exhaust fumes when air is being forced into the cylinders 12A and 12B from the toroidal plenum chambers 38A and 38B. The valving is conventional and will not be described in this application.

The crankshafts 30A and 30B are each of conventional design and include a web portion 58A and 58B respectively, and a crankpin or crank portion 60A and 60B respectively, each rotating about a corresponding one of the main bearings 62A and 62B. Of necessity, the web portions 58A and 58B, crankpins or crank portions 60A and 60B are positioned so that their centers of mass are offset from the axis of rotation of the crankshafts 30A and 30B and cause some vibration forces when orbiting about the axis of rotation. The crankshafts 30A and 30B are arranged about the single piston rod 20 on opposite sides thereof within the crankcase 16 and on the same side of the wings 22A and 22B with their web portions 58A and 58B being oriented in the same position with respect to the cylinders 12A and 12B so as to balance their inertia forces in a direction orthogonal to the single piston rod 20 during rotation.

The crankshafts 30A and 30B are sufficiently heavy to serve as fly wheels, and when they rotate, their web portions 58A and 58B, rotate toward the single piston rod 20 and away from the single piston rod 20 at the same time. Thus, the lateral inertia forces cancel between the two crankshafts. Moreover, the conventional pistons 32A and 32B and cylinders 12A and 12B are arranged so that one piston is going through the power stroke moving downwardly in an opposite direction with respect to the crankcase 16 as the web portion so as to provide further balancing.

In FIGS. 2–5, there is shown a cycle of operation of the diesel engine 10 illustrating the manner in which the forces are balanced by the crankshafts 30A and 30B during a cycle. The diesel engine 10 shown in FIGS. 2–5 has a slightly different placement of the crankshafts 30A and 30B with respect to the side wings 22A and 22B and the longer and shorter portions of the piston rod 20 but the principle is the same.

In FIG. 2, there is shown the conventional piston 32A at the end of its compression stroke and at the beginning of its power stroke after injection of the diesel fuel and the conventional piston 32B at the beginning of its intake stroke with the fumes being evacuated by compressed air from the torodial plenum chamber 38A (FIG. 1). In this position, the single piston rod 20 is closest to the cylinder 12A (FIG. 1) within the crankcase 16 and the connecting rods 28A and 28B are substantially straight with the web portions 58A and 58B being furthest from the wings 22A and 22B.

Figure 3:
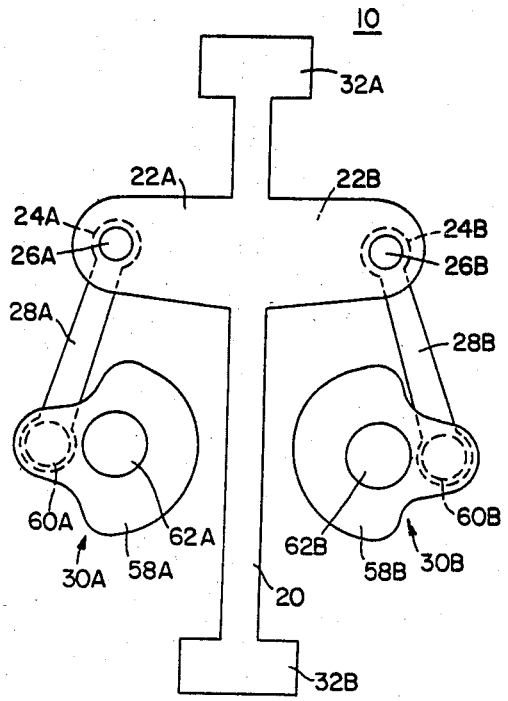

In FIG. 3, the diesel engine 10 is shown with the conventional piston 32A about one-half through the power stroke in which it is compressing air in the toroidal plenum chamber 38A (FIG. 1) and the conventional piston 32B is compressing air within the cylinder 12B (FIG. 1). In this position, the wings 22A and 22B of the single piston rod 20 have moved in the direction of the cylinder 12B (FIG. 1) rotating the web portions 58A and 58B counterclockwise and clockwise respectively so the inertia forces of each are toward the single piston rod 20 and cancel each other out within the crankcase 16. This direction of rotation is achieved because of the position of bearings of crankpins 60A and 60B with respect to the main bearings 62A and 62B, the bearing of crankpins 60A and 60B being positioned further from the single piston rod 20 than the main bearings 62A and 62B at the beginning of the power stroke of conventional piston 32A with the single piston rod 20 closest to the cylinder 12A (FIG. 1).

Figure 4:
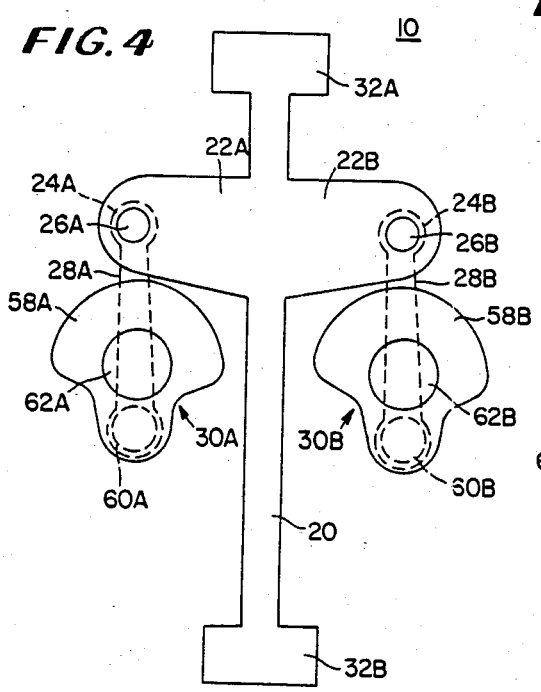

In FIG. 4, there is shown the diesel engine 10 in a position in which the conventional piston 32A is exhausting fumes and intaking air and the conventional piston 32B is at the end of its compression stroke and the beginning of its power stroke after the injection of diesel fuel. In this position, the single piston rod 20 is closest to the cylinder 12B (FIG. 1) within the crankcase 16 and the web portions 58A and 58B have rotated counterclockwise and clockwise respectively in the direction of the cylinder 12A, with their inertia forces in the direction towards cylinder 12A and opposing the inertia forces of the moving central embodiment (pistons and connecting mechanisms) which has inertia forces in direction towards cylinder 12B.

Figure 5:
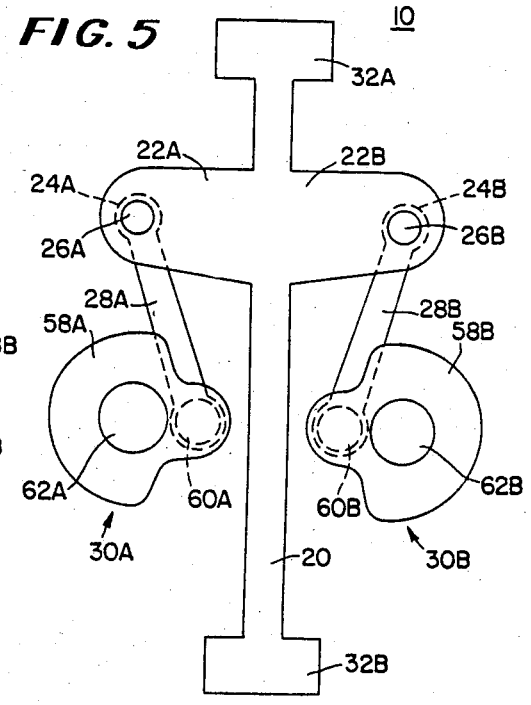

In FIG. 5, there is shown diesel engine 10 with the conventional piston 32A in the process of compressing air and the conventional piston 32B about one-half through its power stroke in which position it is compressing air to the toroidal plenum chamber 38B (FIG. 1). In this position, the web portions 58A and 58B are rotating counterclockwise and clockwise respectively with their inertia forces being outward from the single piston rod 20, thus balancing each other.

From FIGS. 2–5 it can be understood that the horizontal forces toward and away from the single piston rod 20 caused by the inertia forces of the crankshafts 30A and 30B with web portions 58A and 58B oppose and thus balance each other while the vertical forces in the direction of the conventional pistons 32A and 32B are such that the inertia forces of crankshafts 30A and 30B with web portions 58A and 58B oppose the inertia forces of the moving piston and connecting mechanisms (20, 22A, 22B, 24A, 24B, 26A, 26B, 28A, 28B, 32A, 32B, 60A and 60B). Since these forces oppose there is a minimum of vibration and lost power from vibration in the engine.

In FIG. 6, there is shown a top sectional view of the crankshafts 30A and 30B each mounted to rotate a different one of the gears 64A and 64B. The gears 64A and 64B are engaged and the gear 64A drives an output shaft 68. In this manner, the crankshafts 30A and 30B each drive a different one of the gears 64A and 64B in synchronism and output shaft 68 as the crankshafts 30A and 30B are driven by the connecting rods 28A and 28B (FIG. 1) engaging the crankpin 60A and 60B to turn the crankshafts 30A and 30B about the main bearings 62A and 62B.

Figure 7:
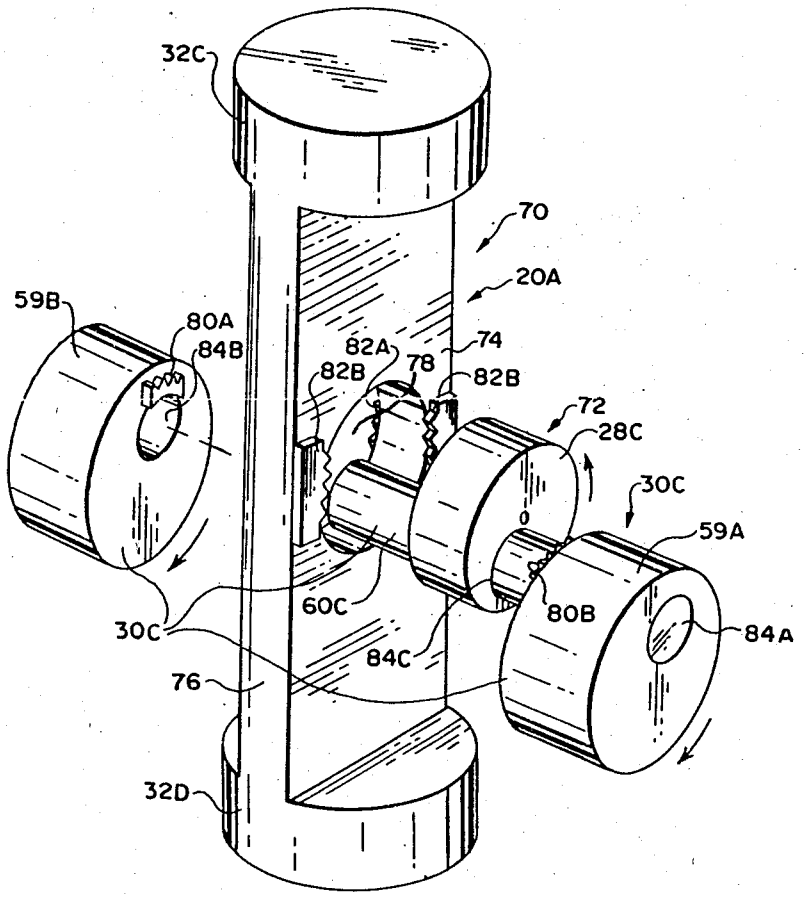
FIG. 7 is an exploded perspective view of a portion of another embodiment of the invention.

In FIG. 7, there is shown a simplified, fragmentary perspective view of another embodiment of the invention having a unitary piston-piston rod assembly 70 and a connector-crank assembly 72. The piston-piston rod assembly 70 reciprocates as part of a reciprocating engine and causes the connector-crank assembly 72 to rotate.

The piston-piston rod assembly 70 includes first and second pistons 32C and 32D and a piston rod 20A. The piston rod 20A is generally shaped as a right regular parallelopiped having first and second parallel flat sides of equal dimensions, one of which is shown at 74, and curved parallel sides connecting the flat sides and having outer surfaces as cylinders, one of which is shown at 76.

On each side of the piston rod 20A is a corresponding one of the two pistons 32C and 32D integrally formed therewith and having a generally cylindrical shape, with a major diameter equal to or approaching that of the curved parallel sides 76 and a cylindrical curvature the same as or approaching the curvature of the sides 76. The two pistons are separated by the length of the flat side 74. Centrally located in the piston rod 20A and passing between the flat sides is a cylindrical hole 78 adapted to receive the connector-crank assembly 72.

The piston-piston rod assembly 70 may be of unit construction as described or assembled by connecting pistons to the piston rod with fasteners. For convenience, the word "fastening" is taken to include combining as in unit construction as well as connecting with fasteners. Curved surface 76 is in contact with the cylinder walls and absorbs the piston side thrust resulting from the forces of the piston through a connector on to the crank. The piston fit against the cylinder walls is looser than the fit of curved surface 76 receives to allow for its thermal expansion. The diameter of the crown of the piston is shorter than the diameter of the skirt portion by less than ten one-thousandths of an inch. In the preferred embodiment the curved surface 76 receives forced oil lubrication and is the primary surface resisting piston assembly side thrust. The surface 76 is also removed from the normal heat build up found in the combustion chamber.

The connector-crank assembly 72 includes a connector 28C, a crankpin 60C and crank journals 59A and 59B. The connector 28C is cylindrical and sized to conform to hole 78 which receives it. The crank journals 59A and 59B include pinion gears portions 80A and 80B on sides adjacent to piston-piston rod assembly 70 which interfaces with complimentary teeth on similar rack gear portions 82A and 82B respectively. Holes 84C in connector 28C and holes 84A and 84B in crank journals 59A and 59B are sized to receive the cylindrical crankpin 60C. Crankpin 60C may be rigidly attached or an integral part of journals 59A and 59B and rotate freely in connector 28C or may be rigidly attached or an integral part of connector 28C and rotate in crank journals 59A and 59B. The center (axis) of crankpin 60C orbits about the center (axis) of crank journals 59A and 59B with the radius of orbit hereafter referred to as the radius of crank rotation.

When assembled, the connector 28C is within a hole 78 and is carried as a whole in the reciprocating motion of the piston-piston rod assembly 70 while it rotates therein. The crankpin 60C is within the hole 84C of the connector 28C within which it rotates while it orbits about the center of the connector 28C as the connector 28C and the piston-piston rod assembly 70 reciprocate. This orbit has a radius equal to the radius of rotation of the crank 30C and causes rotation of the crank to impart rotary motion in response to the piston stroke, which is four times the radius of rotation of the crank or four times the radius of the rotation of the crankpin about the center of the connector.

Figure 8:
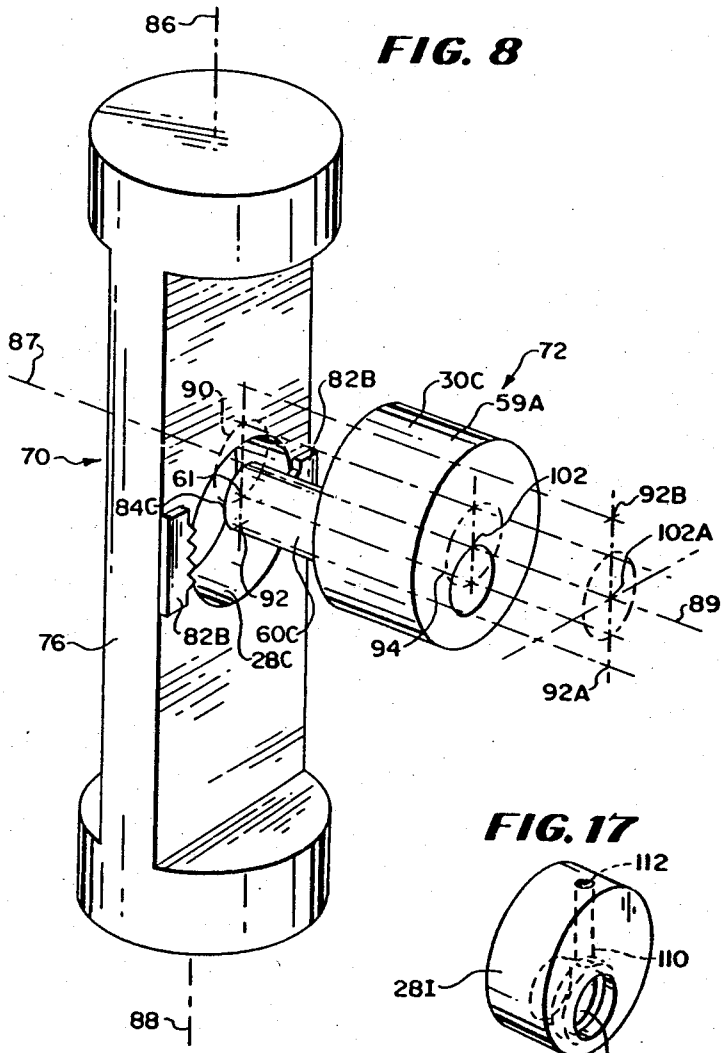
FIG. 8 is a simplified illustrative view of the embodiment of FIG. 7.

In FIG. 8, there is shown an illustrative drawing of the piston-piston rod assembly 70 at the bottom of its stroke and connector-crank assembly 72 having centerlines 86 and 88 for the piston-piston rod assembly 70 illustrating its direction of motion and hidden lines 90 illustrating the motion of the crankpin 60C with respect to center lines 87 and 89 of the crank 30C.

As shown in this figure, the piston-piston rod assembly 70 reciprocates in a linear direction along the lines 86 and 88. The centerpoint 92 of the connector 28C reciprocates in the same direction by the same amount as the piston stroke and that is twice the diameter of a circle 90 shown in FIG. 8. The center 61 of the crankpin 60C describes the circle 90 on the piston-piston rod assembly 70 as it reciprocates.

The circle 90 is shown projected on the crank journal 59A of the crank 30C as a circle 94 having a center 102. Centerpoint 92 and center 102 are aligned when the piston-piston rod assembly 70 is centered at midstroke. The center 102 of the circle 94 is the center of rotation of the crank 30C.

The center of rotation 102 of the crank is projected to 102A and the projections of the center 92 at its two extremes of travel are shown at 92A and 92B. At midstroke the projection of center 92 coincides with 102A.

As shown in these diagrams, as the piston moves upwardly, the center-point 92 of connector 28C describes a circle relative to crankpin center 61 while it reciprocates with piston-piston rod assembly 70 along lines 86 and 88. The circle described by centerpoint 92 relative to crankpin center 61 is of the same diameter as circle 90. As crankpin center 61 orbits crank center of rotation 102, connector centerpoint 92 orbits crankpin center 61 with the same angular velocity but in the opposite direction. The resulting additive motion of centerpoint 92 is a linear movement of twice diameter 90 or as projected the distance between 92A and 92B. The velocity of centerpoint 92 and likewise the piston-piston rod assembly 70 is twice the velocity of crankpin center 61 in the linear direction along the lines 86 and 88.

As can be understood from this diagram, the orbiting action takes place to permit reciprocation of the piston while the crank is held for rotation about its central axis, with the crankpin 60C rotating in one direction while connector 28C rotates in the opposite direction. However, there is a possible discontinuity of motion when the piston-piston rod assembly 70 is centered at midstroke.

At the center of the stroke, the connector has a second degree of freedom permitting it to rotate in the same direction as the crank with its center of velocity equal to zero. This discontinuity is corrected by a crank-piston interface to insure continuity of direction, velocity and acceleration through this point. The interface is achieved by a crank to piston assembly interface such as a cam-slider or a gear interface.

At midstroke when centerpoint 92 of connector 28C is aligned with center of rotation 102 as projected on 102A, it is possible for connector 28C to be driven by the crankpin 60C to rotate with the same angular velocity and in the same direction as crankpin 60C, resulting in a zero movement and a zero linear velocity of centerpoint 92 and likewise for piston-piston rod assembly 70.

There are two possible sets of movement at the center of the stroke which are: (1) the crank rotates in one direction, the connector rotates in the opposite direction and the piston assembly is oscillating moving twice the velocity of the center of the crankpin or the same velocity of the center of the connector and (2) the crank rotates in one direction, the connector rotates in the same direction and the piston assembly has zero velocity as does the center of the connector. The cam-cam follower interface, such as a cam slider and/or gear interface, is between the crank and piston assembly to insure continuity of movement through the center of the stroke since there are two degrees of freedom.

This occurs because the center of rotation of the connector coincides with the center of rotation of the crank so that the orbiting of the crankpin about the center of rotation of the crank only causes rotation of the connector without linear motion, thus the inertia driving the crank or the rotary force imposed by other pistons which may be in a power stroke does not move the piston to its ignition point but instead it is left centered at midstroke.

In the embodiment of FIG. 7 to prevent this discontinuity at start ups and at low RPMs, pinion gears portions 80A and 80B engage with complimentary teeth on similar rack gear portions 82A and 82B at midstroke. Rack gear portions 82A and 82B are integral of or attached near the center edges of piston-piston rod assembly 70 while the pinion gears portion 82A and 82B are located on the sides of crank journals 59A and 59B that are adjacent to piston-piston rod assembly 70.

From FIG. 8, one location for pinion teeth (not shown in FIG. 8) would be on a circle twice diameter 94 on the inside face of crank journal 59A and adjacent to the point of intersection 92 and 92A. This will match pinion teeth velocity in the direction of lines 86 and 88 with the velocity of rack gear portions 82B. Gear interface at midstroke would constitute a true rack and pinion engagement. However, a modified rack and pinion gear interface is superior for positions on either side of midstroke, since $Vr = Vp \sin.T$ where $Vr$ = Velocity of rack, $Vp$ = Pitch velocity of pinion gear 80A or 80B and T is the angle the pinion gear makes with a corresponding rack 82A or 82B with $T = 90$ at midstroke when the pinion gear is in contact with its corresponding rack. True rack and pinion action is actually approximated until T varies significantly from 90 but is within 10 percent of true driver-driver rack and pinion action near midstroke. The linear velocity in directions of line 86 and 88 for the pinion gears at described point is at all times the same as piston-piston rod assembly 70.

Figure 15:
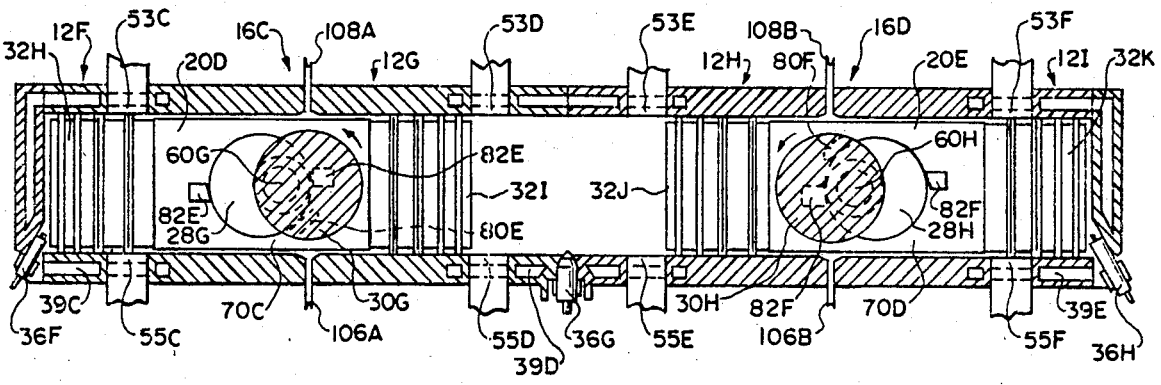
FIG. 15 is a longitudinally-sectioned, elevational view of still another embodiment of the invention.
Figure 16:
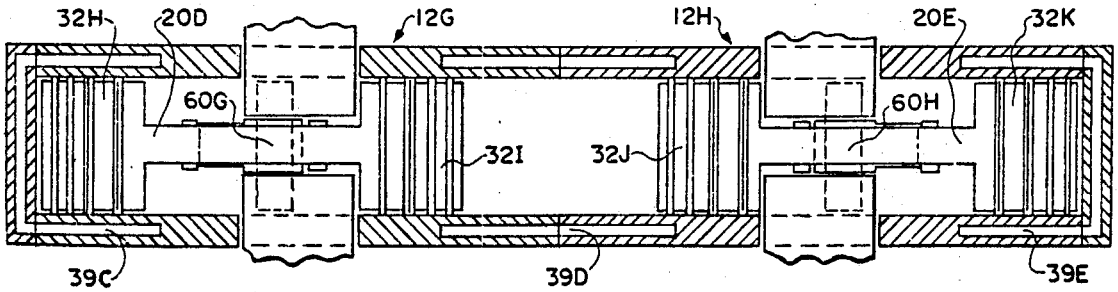
FIG. 16 is a longitudinally-sectional top view of the embodiment of FIG. 15.

While gears are described as the means for controlling the continuity of motion through midstroke, other means may be used. A cam slider mechanism as shown in FIGS. 15 and 16 is one of them. Another is the cam slider mechanism shown in FIGS. 18 and 19 where the point of contact between the cam lobe and the cam follower is of a velocity twice that of the center of the crankpin in the direction of oscillation of the piston-piston rod assembly. In addition the modified rack and pinion described may have modification to their position and/or change in tooth profile to the extent of being more cam slider than true involute. Any mechanism resulting in a crank-piston rod interface that causes the motion of the piston-piston rod assembly to have a velocity that is twice that of the center of the crankpin's velocity in the axis of oscillation of the piston-piston rod assembly through a predetermined distance of midstroke may be used. Generally the inertia forces of the piston assembly except during start and low RPMs will carry itself through midstroke with no need for a positive interface at the point of discontinuity.

Figure 9:
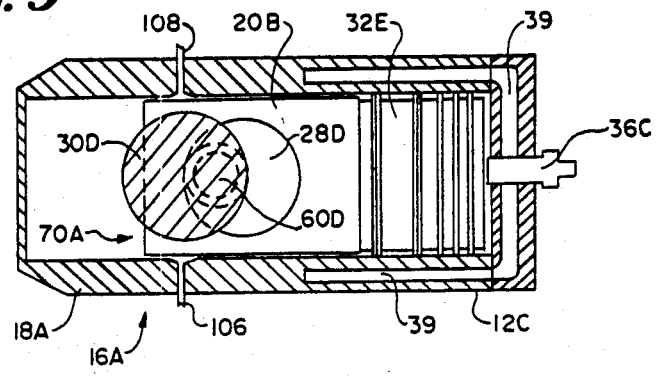
FIG. 9 is a sectioned, simplified elevational view of an embodiment of the invention.

In FIG. 9, there is shown a simplified sectional view of a piston-piston rod assembly 70A mounted within a cylinder 12C. A diesel fuel injector 36C is mounted to inject fuel into the cylinder and a water chamber 39 communicates with the interior of the cylinder to provide cooling. Lubrication inlets 106 and 108 are provided to lubricate the piston-rod assembly 20B.

Lubrication inlets 106 and 108 located adjacent to the skirts and the piston rods and removed from the combustion chamber provide forced oil lubrication to the surfaces encountering side thrust forces that are generally associated with piston skirts in a conventional engine. Since location and magnitude of side thrust on the cylinder walls 12C is dependent largely on the position of connector 28D, the forced oil lubrication should extend from the center of crank 30D in each direction a minimum of one-half the piston stroke where the piston rod 20B and cylinder 12C are in contact. Additional inlets or oil grooves may be used for more even lubrication.

This lubrication arrangement has the advantage of: (1) providing an effective lubricating film to reduce friction between the piston rod 20B and cylinder walls 12C in an area sufficiently removed from the high temperatures of the combustion chamber; and (2) permitting normal piston length to be shortened since piston skirts are no longer necessary to resist piston side thrust.

In the embodiment of FIG. 9, there is only one piston on one side of the piston rod but other pistons may be connected to the crank 30D through separate connectors such as 28D for the rod 20B. In operation, the piston 32E is driven outwardly by the explosion of diesel fuel, causing the connector 28D to move forward (to the left in FIG. 9) so that the crankpin 60D changes position within the rod by rotating the connector 20B and this causes the crank 30D to rotate about its center. The kinetic energy of a flywheel, or in the case of a multi-cylinder engine, the kinetic energy of the flywheel and the power stroke of other pistons then continue the rotation of the crank so as to bring the piston back into a compression portion of the cycle at the end of which the diesel fuel is ignited and it returns back in a drive portion of its cycle.

Figure 10:
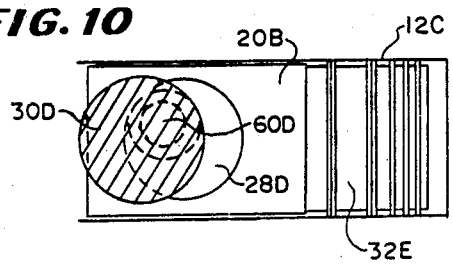
FIGS. 10–13 are developed views illustrating the operation of the embodiment of FIG. 9.

This sequence is illustrated better by FIGS. 10–13. As shown in FIG. 10, the piston 32E is moving forward after an explosion within cylinder 12C and the crankpin 60D is rotating in a counter-clockwise direction from its three o'clock position toward its twelve o'clock position as the piston 32E, piston rod 20B and center of the connector move to the left.

Figure 11:
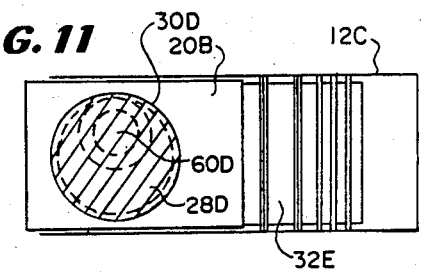
Figure 12:
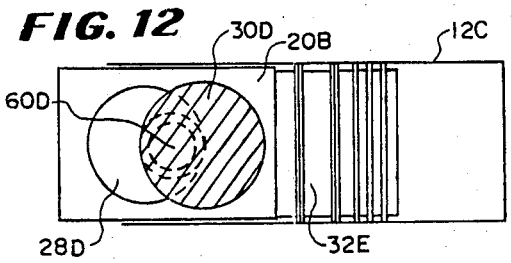

In FIG. 11, the crankpin 60D is in the twelve o'clock position, having rotated the crank 30D and the connector 28D. In FIG. 12, the crankpin 60D is in its nine o'clock position, with the piston 32E completing its power stroke and being at its leftmost extreme. The crank 30D has now rotated counterclockwise through a hundred and eighty degrees and the crankpin 60D has orbited counterclockwise through a corresponding one hundred and eighty degrees with the rotation of the connector 28D through one hundred and eighty clockwise degrees.

Figure 13:
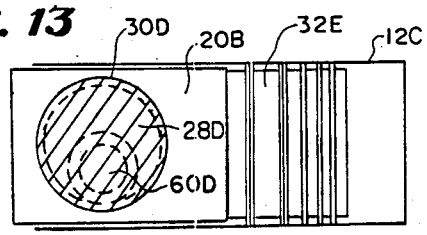

In FIG. 13, the crankpin 60D has now rotated at its six o'clock position and the piston 32E is starting back in its compression portion of the cycle. This process continues through successive cycles so as to turn the crank 30D.

The workings of FIG. 9 through FIG. 13 applies equally for a single crank engine with one or multiple piston-piston rod assemblies as so described in FIGS. 8 and 9. Likewise, the single piston rod embodiment of FIG. 9 will generally use a crank-piston rod interface to carry it through midstroke as so described from FIGS. 7 and 8. Conventional crankshaft counterweights and balancing would generally be desirable for either the piston rod assembly or the piston-piston rod assembly with either one or multiple connectors.

Figure 14:
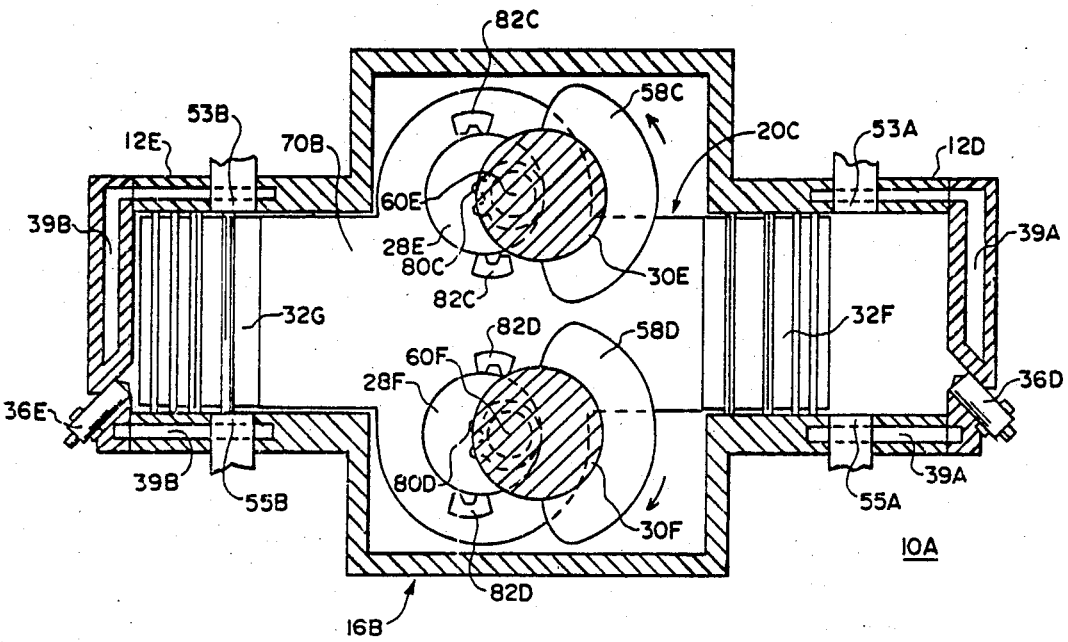
FIG. 14 is an elevational view of still another embodiment of the invention.

In FIG. 14, there is shown still another embodiment of the engine 10A, having a piston-piston rod assembly 70B with two pistons 32F and 32G mounted within different cylinders 12D and 12E for reciprocation therein to move a common piston rod 20C back and forth within the crankcase 16B. The piston rod 20C has a central portion with two connectors 28E and 28F mounted side by side along the line transverse to the line of motion of the piston-piston rod assembly 70B, each driving a corresponding one of the crankpins 60E and 60F of the corresponding cranks 30E and 30F.

The internal gear and pinion mechanisms 82C, 82D, 80C and 80D are mounted so that the cranks 30E and 30F rotate with continuity through midstroke. In the embodiment of FIG. 14, the cranks may be connected to a single output shaft 68 through a mechanism described and shown in FIG. 6 so that cranks 30E and 30F rotate synchronized in opposite directions, with the crank 30E and web 58C rotating in a counterclockwise direction and crank 30F and web 58D in a clockwise direction. With this mechanism, the inertia forces are balanced as in the embodiment of FIG. 1 but with a more compact engine. Two cycle scavenging using parts 53A, 53B, 55A and 55B is conventional. Valves may also be used.

The embodiment of FIG. 14, like that of FIG. 1, has essentially no side thrust since the transverse forces of the connectors 28E and 28F on piston-piston rod assembly 70B oppose each other. Unlike FIG. 1, the embodiment of FIG. 14 can be completely balanced using webs 58C and 58D, since the linear motion, velocity and acceleration of the piston-piston rod assembly 70B can be expressed as a simple sine-cosine function based on crank rotation just as the linear motion of webs 58C and 58D.

The embodiment of FIG. 1, like conventional connecting rod engines, requires an additional function based on the ratio of connecting rod length to the crank radius. The simple sine-cosine movement of piston-piston rod assembly 70B unlike conventional connecting rod engines, gives the embodiment (FIG. 14) such advantages as: (1) ease in balancing; (2) slower piston velocity per degree crank rotation during injection, thus permitting improved burning or faster diesel RPM; and (3) a more compact engine.

In FIGS. 15 and 16, still another embodiment of engine is shown which includes two aligned piston-piston rod assemblies 70C and 70D, each of which is substantially the same as the embodiments of FIGS. 7 and 8. They are mounted to cranks, each of which is substantially the same as the connector-crank assemblies 72 in FIGS. 7 and 8, but the piston-piston rod assemblies 70C and 70D are aligned with each other so that two of the pistons 32I and 32J share a common cylinder and common fuel injecter 36G.

In this embodiment, two parallel cranks are provided and synchronized in their rotation so their respective piston-piston rod assemblies 70C and 70D reciprocate, with pistons 32I and 32J moving together and then apart in compression and expansion strokes within the same chamber. The two parallel cranks may be synchronized in either the same direction or in opposite direction of rotation. If synchronized in opposite directions, the cranks in the embodiment of FIGS. 15 and 16 may be connected to the single output shaft 68 through a mechanism as described in FIG. 6. If synchronized in the same direction, the cranks in the embodiment of FIGS. 15 and 16 may be connected to a single output shaft through a mechanism similar to FIG. 6 but where the gears 64A and 64B are replaced by positive drive pulleys and then connected by a positive drive belt.

Vibrations are easily minimized in the embodiment of FIGS. 15 and 16 since the cranks 30G and 30H may be synchronized so that the momentums of piston-piston rod assemblies 70C and 70D oppose each other. This leaves only the balancing of connector 28G and 28H and the crankpin 60G and 60H left. Since their momentums oppose each other in the direction of oscillations, only minor transverse vibrations need attention. The transverse vibrations are small enough to be disregarded but may be corrected with crank counterweights.

In FIG. 15, there is shown an embodiment with cranks 30G and 30H rotating counterclockwise and using cam slider mechanisms 80E, 82E, 80F and 82F.

Cam slider portion 80E is rigidly attached or is an integral part of crank 30G as is portion 80F on crank 30H. Portions 80E and 80F lead crankpins 60G and 60H respectively by about 90 degrees. Cam slider portions 82E and 82F are mounted rigidly or as integral parts of piston-piston rod assemblies 70C and 70D respectively. The position of cam slider portions 82E and 82F on piston-piston rod assemblies 70C and 70D is such that at midstroke, portions 80E and 80F, which lead crankpins 60G and 60H by about $\frac{1}{4}$ turn, are in contact with portions 82E and 82F and the sliding action exerts a force radially out from crank centers from portions 80E and 80F providing force to portions 82E and 82F in the direction of piston-piston rod oscillation.

This mechanism insures at midstroke that the piston rod assemblies do not lag behind the crank but does keep them from running ahead of the crank. The control mechanism of FIGS. 7–14 and 18 and 19 on the other hand disciplines the piston rod assembly from either lagging behind or running ahead. However, the embodiment of FIGS. 15 and 16 may just as easily utilize the modified rack and pinion gear mechanism to insure proper movement through midstroke. to further reduce cost, the embodiment of FIGS. 15 and 16 may utilize neither mechanism, especially if using a compressed air starter system, despite certain limitations. Any one of the cam slider interface, the gear interface or no interface could likewise be used in FIG. 14 and in FIG. 9 for the piston rod assembly or for a piston-piston rod assembly.

Piston-piston rod assemblies 70C and 70D in the embodiment of FIGS. 15 and 16 experience side thrust forces. Lubrication inlets 106A, 106B, 108A, and 108B provide forced oil lubrication at those surfaces in the manner described in FIG. 9.

Figure 17:
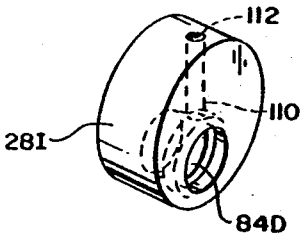
FIG. 17 is a simplified perspective view of a portion of the embodiment of FIG. 7.

To insure proper lubrication, a forced oil system provides oil under pressure through the crank, into the crankpin, to the outer surfaces of the crankpin in the same manner that the conventional engine lubricates the rod bearings. The forced oil lubricates the surfaces in contact where crankpin 60C rotates in mating hole 84C in connnector 28C in FIGS. 7 and 8. In FIG. 17, the embodiment extends the lubrication from hole 84D in connector 28K through passage 110 to oil outlet 112 to provide lubrication between outer surfaces of the connector and the piston rod housing that it rotates in. Outlet 112 will be in advance of the connector surface receiving the power stroke.

Figure 18:
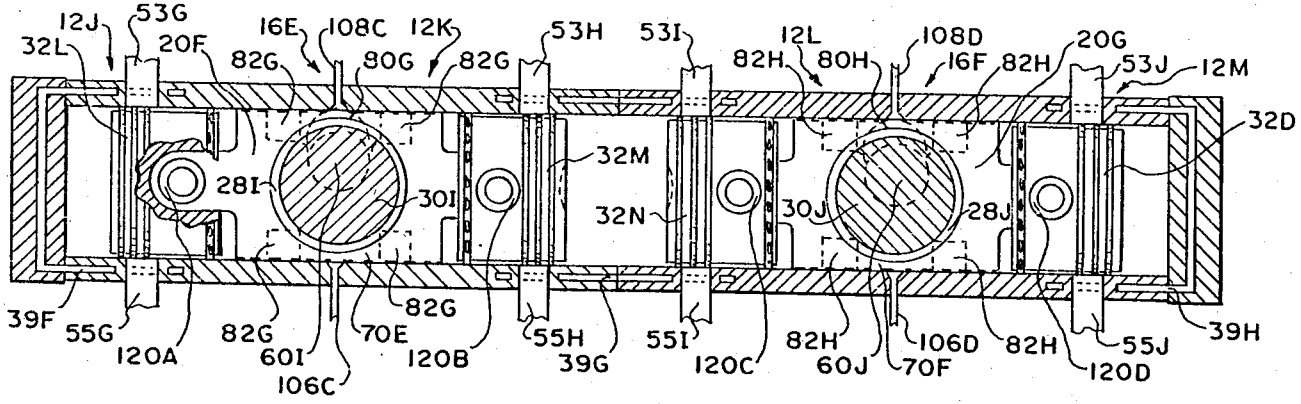
FIG. 18 is a longitudinally-sectioned, elevational view of still another embodiment of the invention.
Figure 19:
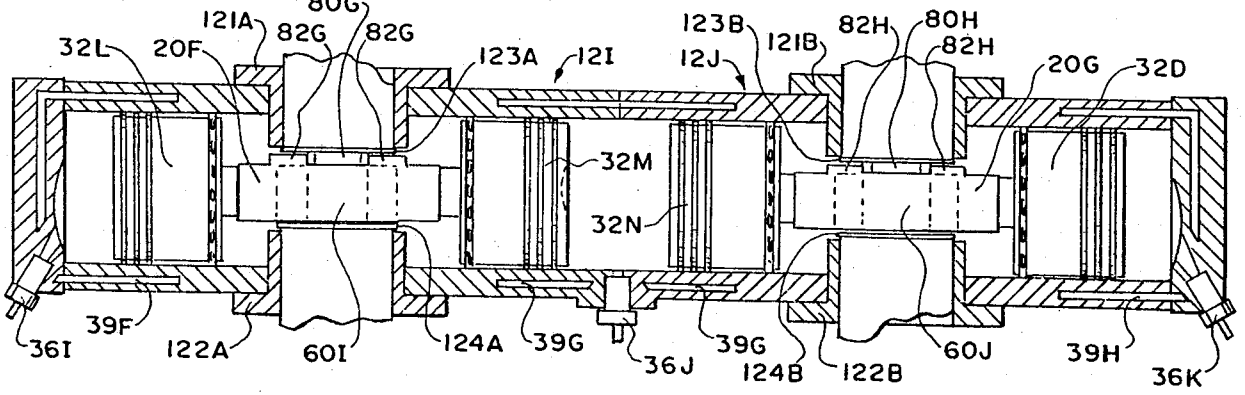
FIG. 19 is a longitudinally-sectioned top view of the embodiment of FIG. 18.

In FIGS. 18 and 19 there is shown another embodiment of engine which is similar in many respects to the engine of FIGS. 15 and 16 but includes as an interface means a novel cam slider mechanism 80G, 80H, 82G and 82H that is functionally similar to the rack and pinion interface 80A, 80B, 82A and 82B (FIGS. 7 and 8). The parts of the embodiment of FIGS. 18 and 19 that are the same as those of FIGS. 15 and 16 have the same reference numbers.

The engine of FIGS. 18 and 19 includes two piston-piston rod assemblies 70E and 70F, each of which is substantially the same as the embodiment of FIGS. 7 and 8. They are mounted to cranks, each of which is substantially the same as the connector-crank assemblies 72 in FIGS. 7 and 8, but the piston-piston rod assemblies 70E and 70F are aligned with each other so that two of the pistons 32M and 32N share a common cylinder and common fuel injector 36J.

In the embodiment of FIGS. 18 and 19 as in the embodiment of FIGS 15 and 16, two parallel cranks are provided and synchronized in their rotation so their respective piston-piston rod assemblies 70E and 70F reciprocate, with pistons 32M and 32N moving together and then apart in compression and expansion strokes within the same chamber. The two parallel cranks may be synchronized in either the same direction or in opposite directions of rotation.

If shnchronized in opposite directions, the cranks in the embodiment of FIGS. 18 and 19 may be connected to a single output shaft 68 (FIG. 6). If synchronized in the same angular direction, one crank is 180 degrees out of phase with the other so that the two corresponding parts of the pairs of parts that are balanced are moving towards and then away from each other, such as for example: (1) crankpins 60I and 60J; (2) connectors 28I and 28J; (3) cam lobes 80G and 80H; and (4) piston-piston rod assemblies 70E and 70F respectively. One crankpin is at the 12 o'clock position as shown in the embodiment of FIG. 11 when the other crankpin is at the 6 o'clock position as shown in the embodiment of FIG. 13. To synchronize parallel parts in the same angular direction, the cranks in embodiment of FIGS. 18 and 19 are connected to a single output shaft through positive drive pulleys and then connected by a positive drive belt.

To reduce vibrations in the embodiment of FIGS. 18 and 19, the cranks 30I and 30J are synchronized so that the momentums of piston-piston rod assemblies 70E and 70F oppose each other. This leaves only the balancing of connectors 28I and 28J, crankpins 60I and 60J and cam lobes 80G and 80H left. Since their momentums oppose each other in the direction of oscillations, only minor transverse vibrations need attention. The transverse vibrations are quite small and may be disregarded or corrected with crank counterweights.

To insure proper movement of connectors 28I and 28J through midstroke, the cam-cam follower mechanism includes cam lobes 80G and 80H on cranks 30I and 30J and cam followers 82G and 82H on piston-piston rod assemblies 70E and 70F respectively. An endless multitude of cam-cam follower profiles and locations may be described and used to limit the connectors to one set of motion to insure smooth continuous movement through midstroke. For example, cam followers 82G and 82H are rigidly attached or are integral parts of piston-piston rod assemblies 70E and 70F respectively with their contact edges transverse to the axis of oscillation of the piston assemblies.

Cam lobes 80G and 80H are of circular profile for those portions that do contact the cam followers through a predetermined distance of midstroke. The cam lobes 80G and 80H are rigidly attached or are integral parts of the cranks 30I and 30J. The axes of symmetry used to generate the cylindrical profile portions of the cam lobes 80G and 80H, hereafter referred to as the cam lobes centers, are located on lines extending radially out from the axes of rotation of the cranks 30I and 30J through the geometric centers of crankpins 60I and 60J respectively with the radial distances of the cam lobes centers from the cranks axes of rotation within a stationary housing 18 (FIG. 1) being twice that of the crankpins' orbital radii about the axes of rotation of the cranks.

Since the points of engagement on each cam lobe are on a circular profile around the cam lobe center and the points of engagement on each cam follower are transverse to the axis of oscillation of the piston assemblies, then the points of engagement on each cam lobe will be in contact with the cam follower only when the line from the point of engagement to the cam lobe center is parallel to the axis of oscillation of the piston assemblies and during contact will thus have a velocity of zero with respect to the cam lobe center in the direction parallel to the axis of oscillation of the piston assemblies.

The cam lobes thus impart or restrict the cam followers to the velocities of the centers of the cam lobes parallel to the linear velocities of oscillation of the piston assemblies. The angular velocities of the center of the cam lobe 80G and the center of crankpin 60I about the axis of rotation of crank 30I within a stationary housing are the same, and since the radial distance from the center of cam lobe 80G to the axis of rotation is twice that of the orbital radius of crankpin 60I about the axis of rotation, then the velocity of the center of cam lobe 80G in the direction parallel to the axis of oscillation of the piston assembly 70E with respect to the housing, is twice that of the center of crankpin 60I in the same direction, and thus is the same as the center of connector 28I. The tangential velocities of the points of engagement on the cam lobes 80G and 80H of the piston-piston rod assemblies parallel to the linear velocity of the oscillation of the piston with respect to the housing is thus twice that of the centers of crankpins 60I and 60J respectively and thus the same as the centers of the connectors 28I and 28J respectively.

This is best shown in the embodiment of FIGS. 7 and 8, which illustrates that the center of the connector moves at twice the velocity as the center of the crankpin in the direction of oscillation of the piston-piston rod assembly. Finally, since the velocity of the center of cam follower lobe 80G in the direction parallel to the axis of oscillation of the piston-piston rod assembly is the same as both the center of connector 28I and the contacting points of engagement on cam lobe 80G in the same said direction, then cam lobes 80G restrict cam follower 82G and likewise piston assembly 70E and connector 28I to one set of motions through midstroke which is twice the velocity of the center of crankpin 60I in the above same said direction. The above applies likewise to cam lobe 80H, crankpin 60J, crank 30J, conector 28J, cam follower 82H and piston assembly 70F, thus permitting the cam-cam followers to eliminate the possible set of motions where the piston assemblies remain stationary while the cranks turn as described in FIGS. 7 and 8.

The relationship between the velocity of the cam lobe and the crankpin may also be described as: $V_{cl}=2V_{cp}$ since $V_{cp}=R_{cp}W$, $V_{cl}=R_{cl}W$, and $R_{cl}=2R_{cp}$ where $V_{cl}$ is the rotational velocity of the center of the cam lobe, $V_{cp}$ is the rotational velocity of the center of the crankpin, W is the angular velocity of the crank with respect to a stationary housing and thus likewise the angular velocity for the cam lobe center and crankpin center, and $R_{cl}$ is the radius from the crank axis to the cam lobe center which is twice $R_{cp}$ which is the radius from the crank axis of rotation in the housing to the crankpin axis center.

The specific cam lobe described was of a circular profile for those profiles that engaged with the cam follower and the cam follower had points of engagement transverse to the axis of piston assembly oscillation. The point of generation of the cam lobe's circular profile, referenced as the cam lobe center, was described as having twice the radius of the crankpin's orbital radius about the crank center of rotation and being on the line extending radially out from the center of crank rotation and continuing through the crankpin center.

Since the cam lobe center and crankpin center are on the same line extending out from the crank center of rotation, then also $V_{cl}$ Sin.T$=2V_{cp}$ Sin.T where "T" is the angle the crank makes at the time being considered with respect to the axis of oscillation of the piston assembly in a counterclockwise direction with zero degrees being defined with the piston assembly at its extreme right of travel, and "T" will be 90 degrees at midstroke when the piston assembly is moving in one direction along the axis of oscillation and "T" will be 270 degrees at midstroke when the assembly moves in the opposite direction. Also $V_c=2V_{cp}$ Sin.T. where $V_c$ is the velocity of the center of the connector since the connector is connected to the crankpin and rotates around the crankpin axis with an equal but opposite angular velocity and has a radius from the crankpin axis to the connector center of rotation that is equal to the radius from the crank axis of rotation to the crankpin axis.

Since the velocity of the center of the connector is restricted to along the axis of piston assembly oscillation, the component velocities of the crankpin around the crank center and the connector around the crankpin center are equal and additive in the direction of oscillation but cancel in the transverse direction giving $V_c=2V_{cp}$ Sin.T. Finally, $V_{cl}$ Sin.T.$=V_c$ because both equal $2V_{cp}$ Sin.T. and since the cam lobe profile is circular around the cam lobe center and the cam followers profile is transverse to the axis of oscillation, the points of engagement of the cam lobe will also exhibit velocity $2V_{cp}$ Sin.T. as they come in contact with the cam follower. This is true because the cam lobe's points of engagement that are in contact with the cam follower are always the same distance from the cam lobe center, thus their velocity with respect to the cam lobe center is zero since velocity is the change of distance with respect to time. The cam will thus engage the cam followers as it approaches midstroke and insure through midstroke that the piston rod assembly moves with continuity at the continuing velocity of $2V_{cp}$ Sin.T.

In the embodiment of FIGS. 18 and 19, the crankpins 60I and 60J, and cam lobes 80G and 80H are shown at their 12 o'clock position with T equal to 90 degrees. In this position the cam lobes 80G and 80H are sandwiched between cam followers 82G and 82H. The diameter of the circular profile of the cam lobe that contacts the cam followers is slightly less than the distance between the cam followers to closely discipline the movement of the piston-piston rod assembly through midstroke.

The cam follower mechanism may have various locations but a preferred location is with the center of the cam lobe on the line extending radially out from the center of the crank rotation and continuing through the crankpin center. This location is advantageous in ease of construction to not only keep the piston-piston assembly from lagging behind the crank during starts but also to keep it from running ahead of the crank while the engine is operating under a load. The duration of the cam-cam follower interface is generally necessary only for about 25 degrees before midstroke to about 25 degrees after midstroke to guard the connector against its second degree of freedom as described in embodiment FIGS. 7 and 8. Generally, the duration should not exceed about 50 degrees before and after midstroke because the motor becomes unnecessarily expensive.

The cam-cam follower mechanism described in embodiment 18 and 19 was a specific example. The velocity that the cam lobe constrained on the cam follower was twice the velocity of the center of the crankpin in the direction parallel to the axis of piston assembly oscillation where the velocity of the cam lobe center with respect to the axis of crank rotation was twice that of the crankpin center in the same said direction while the velocity of the cam lobe in contact with the cam follower with respect to the cam lobe center was zero in same said direction.

The location of the cam lobe center and the profiles of the cam lobe can be unlimited where the velocity of the cam lobe center with respect to the crank's axis of rotation in the direction of piston assembly oscillation is greater or lesser than in the example provided the cam lobe profile is such that its velocity of its contacting points of engagement with respect to the cam lobe center in the direction of piston assembly oscillation is lesser or greater and results in a velocity of twice that of the crankpin center with respect to the crank's axis of rotation in the same said direction. Also, the cam follower profile need not be transverse to the axis of piston assembly oscillation as long as the cam lobe center and/or profile is such that it will still constrain the cam follower and likewise the piston-piston rod assembly to a velocity of twice the center of the crankpin in the direction parallel to piston assembly oscillation.

The possible cam follower profiles and cam profiles could be various utilizing straight lines, circles, arcs, involutes, or even polynomial curves provided they constrain the piston assembly to a velocity that is twice the velocity of the center of the crankpin in the direction parallel to the axis of piston assembly oscillation through a predetermined distance of midstroke. Any control mechanism (gear, cam slider, cam follower inclusive) that through a predetermined distance of midstroke imparts or restrains motion from the crank to the piston assembly that is sinosoidal and where the piston assembly achieves its maximum velocity at midstroke and where that maximum velocity is substantially twice the orbital velocity of the center of the crankpin about the axis of crank rotation may be used.

Although one specific cam-cam follower profile has been described for the embodiment of FIGS. 18 and 19, a large number of cam-cam follower profiles can be used. Such profiles range from a group of cam slider mechanisms with primarily a sliding contact between the cam and the cam followers to a group where the action between the cam and cam follower is a rolling contact. The action between the cam and cam followers may be involute in nature and yet satisfy the equation $2V_{cp}$ Sin.T.

Rack and pinion gearing is also included for the purposes of this application, and true rack and pinion gearing may satisfy the equation $2V_{cp}$ but would not be inclusive of the sine T function unless modified for the sine function. All of these mechanisms are within the meaning of cam and cam follower as used in this description. However, gearing would sufficiently satisfy the equation $2V_{cp}$ Sin.T. for a small portion of midstroke since Sin.T=1 when T=90 degrees but for an interface of up to 30 degrees before and after exact midstroke the preferred embodiment is a cam-cam follower imparting motion satisfying $2V_{cp}$ Sin.T. including the subset of cams that are involutes or gear portions the conjugate surfaces of which are modified to satisfy the relation $2V_{cp}$ Sin.T. where again $V_{cp}$ is the velocity of the center of the crankpin and $2V_{cp}$ Sin.T. is twice the component velocity of the crankpin on the axis of oscillation of the piston-piston rod assembly.

In the embodiment of FIGS. 18 and 19 the engine includes main bearing housings 121A, 122A, 121B and 122B (FIG. 19) and crank lips 123A, 124A, 123B and 124B that maintain the crank centered between main bearing housings 121A, 122A, 121B and 122B. The housings permit the connectors 28I and 28J and cranks 30I and 30J to be assembled into the piston-piston rod assemblies 70E and 70F by passing them through the openings in crankcases 16E and 16F into which the main bearing housings are assembled thereafter. Housings 121A and 122A extend into crankcase 16E and serve to reduce the flexural stress on crank 30I and crankpin 60I thus permitting smaller crank and crankpin dimensions. Housings 121B and 122B do likewise. Piston pins 120A, 120B, 120C and 120D serve as fasteners to connect the pistons with their respective piston-piston rods.

To insure proper lubrication to the embodiment of FIGS. 18 and 19 a forced oil system provides oil under pressure from crankcases 16E and 16F through main bearing housings 121A, 122A, 121B and 122B through cranks 30I and 30J into the crankpins 60I and 60J and to their outer surfaces in the manner that the conventional engine lubricates rod and journal bearings. The forced oil lubricates the surfaces in contact where crankpin 60C rotates in mating hole 84C in connector 28C in FIGS. 7 and 8. The lubrication between the connector and the piston rod housing is as described in the embodiment of FIG. 17.

Piston-piston rod assemblies 70E and 70F in the embodiment of FIGS. 18 and 19 experience side thrust forces. Lubrication inlets 106C, 106D, 108C and 108D provide forced oil lubrication at those surfaces as described in connection with FIG. 9.

Although a two-cylinder diesel engine has been described, obviously other types of engines may incorporate the invention and diesel engines with more cylinders may include the invention. External combustion engines as well as internal combustion engines, air compressors and pumps may also incorporate the invention. Of course, different cranks with a larger number of crankpins, webs and throws may be necessary. For convenience, the word pump is taken to include compressors because of their similarity of structure.

As can be understood from the above description, the balanced engines of this invention have several advantages, such as: (1) they are economical in construction because of their simplicity, particularly when used as a two-cycle cylinder diesel engine since they operate smoothly without a large number of cylinders and expensive fuel injectors; (2) they provide operation with less vibration than unbalanced engines; (3) they provide operation with less crank stress and friction; (4) they provide efficiency by reducing the amount of energy used to generate harmonic vibrations rather than useful work; and (5) FIGS. 7–16 and FIGS. 18–19 are more compact than conventional engines.

Although a specific embodiment has been described, many modifications and variations of the embodiments are possible within the light of the above teachings without deviating from the invention. Therefore, it is to be understood that, within the scope of the appending claims, the invention may be practiced other than as specifically described.

What is claimed is:

1. Apparatus comprising:

a piston assembly;

said piston assembly including at least one piston and at least one piston rod;

said at least one piston rod being adapted to be reciprocated within a housing in a direction of reciprocation;

at least one cylinder having walls in which at least one piston reciprocates therein forming at least one combustion chamber;

a crank having an axis of crank rotation;

a crankpin having a center;

the center of the crankpin having a radius of crank rotation about the axis of crank rotation;

said at least one piston rod having a piston rod stroke length of travel and a center of midstroke position halfway between ends of the stroke length of travel;

means for fastening at least one piston to said at least one piston rod, wherein alternatingly said rod is driven by said piston and then said piston is driven by said rod;

connector means adapted to be attached to the crankpin;

said connector means being rotatably mounted to said at least one piston rod;

said connector means having a center of connector rotation;

a resulting distance from the center of rotation of said connector means to the crankpin center being equal to said radius of crank rotation;

said piston rod stroke length of travel being equal to substantially four times the radius of crank rotation, whereby the connector means rotates with an angular velocity same as but in a direction opposite that of the crank;

interface means between said crank and said at least one piston rod for controlling motion, through only a predetermined distance portion of midstroke between the crank and the piston rod wherein the piston rod achieves its maximum velocity which is substantially twice an orbital velocity of the center of the crankpin about the axis of crank rotation;

said interface means being positioned to engage at least a length of surfaces substantially at the piston midstroke through said predetermined distance portion of midstroke to produce a velocity of the piston rod substantially twice that of a component of the orbital velocity of the crankpin center in the direction of reciprocation of the piston rod through said predetermined portion of midstroke so as to force and maintain continuity of piston rod movement during said reciprocation; and said predetermined distance portion of midstroke being that distance necessary to insure continuity of piston rod movement of up to about 50 degrees of crank rotation about before and after said center of midstroke.

2. Apparatus according to claim 1 in which:

at least a portion of said piston rod substantially conforms to the cylinder walls in which said piston rod reciprocates in shape and dimensions perpendicular to the direction of reciprocation;

said connector means being rotatably mounted centrally to said piston rod;

side thrust forces between said piston assembly and said cylinder walls are encountered on the surface of said piston rod near said connector means and removed from said at least one combustion chamber; and forced oil lubrication lubricates said surfaces.

3. Apparatus according to claim 1 in which:

forced oil lubrication is provided to said crank;

said forced oil lubrication is channeled through said crank and through said crankpin and lubricates contacting surfaces between said crankpin and said connector means; and oil passages in said connector means allow said forced oil lubrication to flow from said crankpin through said connector means to lubricate contacting surfaces between said connector means and said at least one piston rod.

4. Apparatus comprising:

a piston assembly;

said piston assembly including a piston rod and at least one piston;

said piston assembly being adapted to be reciprocated within an engine in a direction of reciprocation;

said piston rod including means for fastening said at least one piston to said rod whereby said rod is driven by said at least one piston;

said piston rod including a central portion with two connector means whereby centers of said connector means are mounted substantially parallel and in a plane transverse to a line of reciprocation of said piston assembly;

a first crank with an axis of crank rotation and a second crank with an axis of crank rotation;

said axes of crank rotation are substantially parallel and in a plane transverse to a line of reciprocation of said piston assembly;

said first crank rotates with an angular velocity;

said second crank rotates with an angular velocity same as but in a direction opposite that of said first crank;

said first crank with a crankpin having a center;

said second crank with a crankpin having a center;

the centers of said crankpins having radii of crank rotation about their axes of crank rotation and said radii of crank rotation are equal for said first crankpin and said second crankpin;

said piston rod having a piston rod stroke length of travel and a center of midstroke position halfway between ends of the stroke length of travel;

said first connector means adapted to be attached to said first crankpin and said second connector means adapted to be attached to said second crankpin;

said first connector means and said second connector means being rotatably mounted to said central portion of said piston rod;

said first connector means and said second connector means having centers of connector rotation;

a resulting distance from the center of rotation of said first connector means to said first crankpin center being equal to said radii of crank rotation and a resulting distance from the center of rotation of said second connector means to said second crankpin center being equal to said radii of crank rotation;

said first crankpin center and said first crank axis are in substantially a common plane with said second crankpin center and said second crank axis at said center of midstroke whereby said crankpins are closer to one another in one direction of reciprocation through midstroke and further from one another in an opposite direction of reciprocation through midstroke;

said piston rod stroke length of travel being equal to substantially four times the radii of said crank rotation, whereby said first connector means rotates with an angular velocity same as but in a direction opposite that of said first crank, and whereby said second connector means rotates with an angular velocity same as but in a direction opposite that of said second crank;

interface means between at least one of said first and second cranks and said piston rod for controlling motion, through a predetermined distance portion of midstroke between at least one crank and the piston rod wherein the piston rod achieves its maximum velocity which is substantially twice an orbital velocity of the centers of the crankpins about their axes of crank rotation;

said interface means being positioned to engage at least a length of surfaces substantially at the piston midstroke through said predetermined distance portion to produce a velocity of the piston rod being substantially twice that of a component of the orbital velocities of the crankpin centers in the direction of reciprocation of the piston rod through said predetermined portion of midstroke so as to force and maintain continuity of piston rod movement during said reciprocation; and said predetermined distance portion of midstroke is that distance necessary to insure continuity of piston rod movement of up to about 50 degrees of crank rotation both before and after said center of midstroke.

5. Apparatus according to claim 4 in which:

said first crank has web portions for counterweights to reduce vibrations;

said second crank has web portions for counterweights to reduce vibrations;

said web portions on said first crank and on said second crank oppose inertia forces of said piston assembly in the axis of piston assembly reciprocation; and said web portions of said first crank opposes inertia forces of said second crank in a direction transverse to the axis of piston assembly reciprocation.

6. Apparatus according to claim 5 in which:

said first crank and said second crank are synchronized through gearing; and said interface means includes a cam-cam follower.

7. Apparatus according to claim 6 in which:

said cam-cam follower interface means is rack and pinion gearing; and said rack and pinion gearing imparts motion from said at least one crank to said piston rod that is sinusoidal.

8. Apparatus comprising:

a piston assembly;

said piston assembly including at least one piston and at least one piston rod;

said at least one piston rod being adapted to be reciprocated within a pump in a direction of reciprocation;

a crank having an axis of crank rotation;

a crankpin having a center;

the center of the crankpin having a radius of crank rotation about the axis of crank rotation;

said at least one piston rod having a piston rod stroke length of travel and a center of midstroke position halfway between ends of the stroke length of travel;

means for fastening at least one piston to said at least one piston rod, whereby said piston is driven by said rod;

connector means adapted to be attached to the crankpin;

said connector means being rotatably mounted to said at least one piston rod;

said connector means having a center of connector rotation;

a resulting distance from the center of rotation of said connector means to the crankpin center being equal to said radius of crank rotation;

said piston rod stroke length of travel being equal to substantially four times the radius of crank rotation, whereby the connector means rotates with an angular velocity same as but in a direction opposite that of the crank;

interface means between said crank and said at least one piston rod for controlling motion through only a predetermined distance portion of midstroke between the crank and the piston rod wherein the piston rod achieves its maximum velocity which is substantially twice an orbital velocity of the center of the crankpin about the axis of crank rotation;

said interface means being positioned to engage at least a length of surfaces substantially at the piston midstroke through said predetermined distance portion of midstroke to produce a velocity of the piston rod being substantially twice that of a component of the orbital velocity of the crankpin center in the direction of reciprocation of the piston rod through said predetermined portion of midstroke so as to force and maintain continuity of piston rod movement during said reciprocation; and said predetermined distance portion of midstroke is that distance necessary to insure continuity of piston rod movement of up to about 50 degrees of crank rotation both before and after said center of midstroke.

* * * * *